US011233323B2

(12) United States Patent
Kim et al.

(10) Patent No.: US 11,233,323 B2
(45) Date of Patent: Jan. 25, 2022

(54) ANTENNA MODULE INCLUDING METAL STRUCTURE FOR REDUCING RADIO WAVES RADIATED TOWARD BACK LOBE AND ELECTRONIC DEVICE INCLUDING THE SAME

(71) Applicant: Samsung Electronics Co., Ltd., Suwon-si (KR)

(72) Inventors: Youngsub Kim, Suwon-si (KR); Jungmin Park, Suwon-si (KR); Dongsik Shin, Suwon-si (KR); Youngju Lee, Suwon-si (KR); Jongwook Zeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 88 days.

(21) Appl. No.: 16/739,469

(22) Filed: Jan. 10, 2020

(65) Prior Publication Data

US 2020/0235469 A1 Jul. 23, 2020

(30) Foreign Application Priority Data

Jan. 18, 2019 (KR) ..... 10-2019-0006792

(51) Int. Cl.
*H01Q 1/24* (2006.01)
*H01Q 1/52* (2006.01)
(Continued)

(52) U.S. Cl.
CPC ..... *H01Q 1/526* (2013.01); *H01Q 1/24* (2013.01); *H01Q 1/246* (2013.01); *H01Q 1/38* (2013.01);
(Continued)

(58) Field of Classification Search
CPC ..... H01Q 1/526; H01Q 21/00; H01Q 1/52; H01Q 1/246; H01Q 19/021; H01Q 1/521; H01Q 1/38; H01Q 3/30; H01Q 1/24
(Continued)

(56) References Cited

U.S. PATENT DOCUMENTS 5,710,569 A 1/1998 Oh et al.
5,872,544 A 2/1999 Schay
(Continued)

FOREIGN PATENT DOCUMENTS

JP 4461445 B2 5/2010
JP 2016-116124 A 6/2016
(Continued)

OTHER PUBLICATIONS

International Search Report with Written Opinion dated Apr. 28, 2020; International Appln. No. PCT/KR2020/000565.
(Continued)

*Primary Examiner* — Hai V Tran
(74) *Attorney, Agent, or Firm* — Jefferson IP Law, LLP

(57) ABSTRACT

An antenna module is provided to reduce the radio waves radiated toward a back lobe of the antenna module, and includes a printed circuit board (PCB) including at least one insulating layer, at least one antenna array disposed on an upper surface of the PCB, and at least one metal structure disposed on the upper surface of the PCB configured to shift a phase of radio waves radiated by the at least one antenna array and flowing along the upper surface of the PCB. The radio wave whose phase is shifted by passing through the metal structure is in a destructive interference relationship with a radio wave which is not affected by the metal structure thereby reducing the radio waves radiated toward a back lobe of the antenna module.

18 Claims, 15 Drawing Sheets

(51) Int. Cl.

| | |
|---|---|
| ***H01Q 1/38*** | (2006.01) |
| ***H01Q 19/02*** | (2006.01) |
| ***H01Q 3/30*** | (2006.01) |
| *H01Q 21/00* | (2006.01) |

(52) U.S. Cl.
CPC ..... *H01Q 1/52* (2013.01); *H01Q 1/521* (2013.01); *H01Q 3/30* (2013.01); *H01Q 19/021* (2013.01); *H01Q 21/00* (2013.01)

(58) Field of Classification Search
USPC ..... 343/904
See application file for complete search history.

(56) References Cited

U.S. PATENT DOCUMENTS

| | | | | |
|---|---|---|---|---|
| 5,880,695 | A | 3/1999 | Brown et al. | |
| 6,104,348 | A | 8/2000 | Karlsson et al. | |
| 6,195,063 | B1 | 2/2001 | Gabriel et al. | |
| 6,885,352 | B2 | 4/2005 | Lee et al. | |
| 7,443,345 | B2 * | 10/2008 | Zhang | H01Q 1/246 343/700 MS |
| 2006/0284783 | A1 * | 12/2006 | Mohamadi | H01Q 21/065 343/853 |
| 2009/0027286 | A1 * | 1/2009 | Ohishi | H01Q 9/42 343/750 |
| 2009/0174613 | A1 * | 7/2009 | Liu | H01Q 25/005 343/702 |
| 2012/0235880 | A1 | 9/2012 | Kim et al. | |
| 2012/0286049 | A1 * | 11/2012 | McCormack | H01L 23/66 235/492 |
| 2015/0236408 | A1 | 8/2015 | Kona et al. | |
| 2016/0359461 | A1 * | 12/2016 | He | H01Q 21/065 |
| 2017/0338568 | A1 | 11/2017 | Biancotto et al. | |
| 2018/0040948 | A1 | 2/2018 | Gottl et al. | |
| 2019/0165473 | A1 * | 5/2019 | Yun | H01Q 21/28 |

FOREIGN PATENT DOCUMENTS

| | | | |
|---|---|---|---|
| KR | 10-2000-0029472 | A | 5/2000 |
| KR | 10-2005-0005909 | A | 1/2005 |
| KR | 10-2006-0095011 | A | 8/2006 |
| KR | 10-2012-0104896 | A | 9/2012 |
| KR | 10-1517779 | B1 | 5/2015 |

OTHER PUBLICATIONS

Korean Office Action with English translation dated Sep. 30, 2021; Korean Appln. No. 10-2019-0006792.

* cited by examiner

ANTENNA MODULE INCLUDING METAL STRUCTURE FOR REDUCING RADIO WAVES RADIATED TOWARD BACK LOBE AND ELECTRONIC DEVICE INCLUDING THE SAME

CROSS-REFERENCE TO RELATED APPLICATION(S)

This application is based on and claims priority under 35 U.S.C. § 119(a) of a Korean Patent Application number 10-2019-0006792, filed on Jan. 18, 2019, in the Korean Intellectual Property Office, the disclosure of which is incorporated by reference herein in entirety.

BACKGROUND

1. Field

The disclosure relates to an antenna module including a metal structure for reducing radio waves radiated toward a back lobe and further relates to an electronic device including the antenna module.

2. Description of Related Art

To meet the demand for wireless data traffic having increased since deployment of 4th generation (4G) communication systems, efforts have been made to develop an improved 5th generation (5G) or pre-5G communication system. Therefore, the 5G or pre-5G communication system is also called a 'Beyond 4th generation (4G) Network' or a 'Post long term evolution (LTE) System'. The 5G communication system is considered to be implemented in higher frequency (mmWave) bands, e.g., 60 GHz bands, so as to accomplish higher data rates. To decrease propagation loss of the radio waves and increase the transmission distance, beamforming, massive multiple-input multiple-output (MIMO), Full Dimensional MIMO (FD-MIMO), array antenna, analog beam forming, and large-scale antenna techniques are discussed in 5G communication systems. In addition, in 5G communication systems, development for system network improvement is underway based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation, and the like. In the 5G system, Hybrid frequency shift keying (FSK) and quadrature amplitude modulation (QAM) Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology, have been developed.

In this regard, the Internet, which is a human centered connectivity network where humans generate and consume information, is now evolving into the Internet of Things (IoT) where distributed entities, such as things, exchange and process information without human intervention. The Internet of Everything (IoE), which is a combination of IoT technology and Big Data processing technology through connection with a cloud server, has emerged. As technology elements, such as "sensing technology", "wired/wireless communication and network infrastructure", "service interface technology", and "Security technology" have been demanded for IoT implementation, a sensor network, Machine-to-Machine (M2M) communication, Machine Type Communication (MTC), and so forth, have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services, through convergence and combination between existing Information Technology (IT) and various industrial applications.

In line with this, various attempts have been made to apply 5G communication systems to IoT networks. For example, technologies such as a sensor network, MTC, and M2M communication may be implemented by beamforming, MIMO, and array antennas. Application of a cloud RAN as the above-described Big Data processing technology may also be considered an example of convergence between the 5G technology and the IoT technology.

The above information is presented as background information only, and to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages, and to provide at least the advantages described below. Accordingly, an aspect of the disclosure is to provide an antenna module for reducing radio waves guided along a surface of an antenna array and radiated toward a back lobe and also provide an electronic device including such an antenna module.

Additional aspects will be set forth in part in the description which follows and, in part, will be apparent from the description, or may be learned by practice of the presented embodiments.

In accordance with an aspect of the disclosure, an antenna module in a wireless communication system is provided. The antenna module includes a printed circuit board (PCB) including at least one insulating layer, at least one antenna array disposed on an upper surface of the PCB, and at least one metal structure disposed on the upper surface of the PCB configured to shift a phase of radio waves radiated by the at least one antenna array and flowing along the upper surface of the PCB.

In accordance with another aspect of the disclosure, an electronic device is provided. The electronic device includes an antenna module that includes a printed circuit board (PCB) including at least one insulating layer, at least one antenna array disposed on an upper surface of the PCB, and at least one metal structure disposed on the upper surface of the PCB configured to shift a phase of radio waves radiated by the at least one antenna array and flowing along the upper surface of the PCB.

In accordance with another aspect of the disclosure, it is possible to reduce the amount of radio waves radiated in the back lobe direction of the antenna module, thereby improving the efficiency of the antenna module.

In accordance with another aspect of the disclosure, it is possible to reduce only the amount of radio waves radiated in the back lobe direction without changing the characteristics of radio waves radiated in the main lobe direction.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description, taken in conjunction with the accompanying drawings, in which.

Throughout the drawings, it should be noted that like reference numbers are used to depict the same or similar elements, features, and structures.

DETAILED DESCRIPTION

Figure 1A:
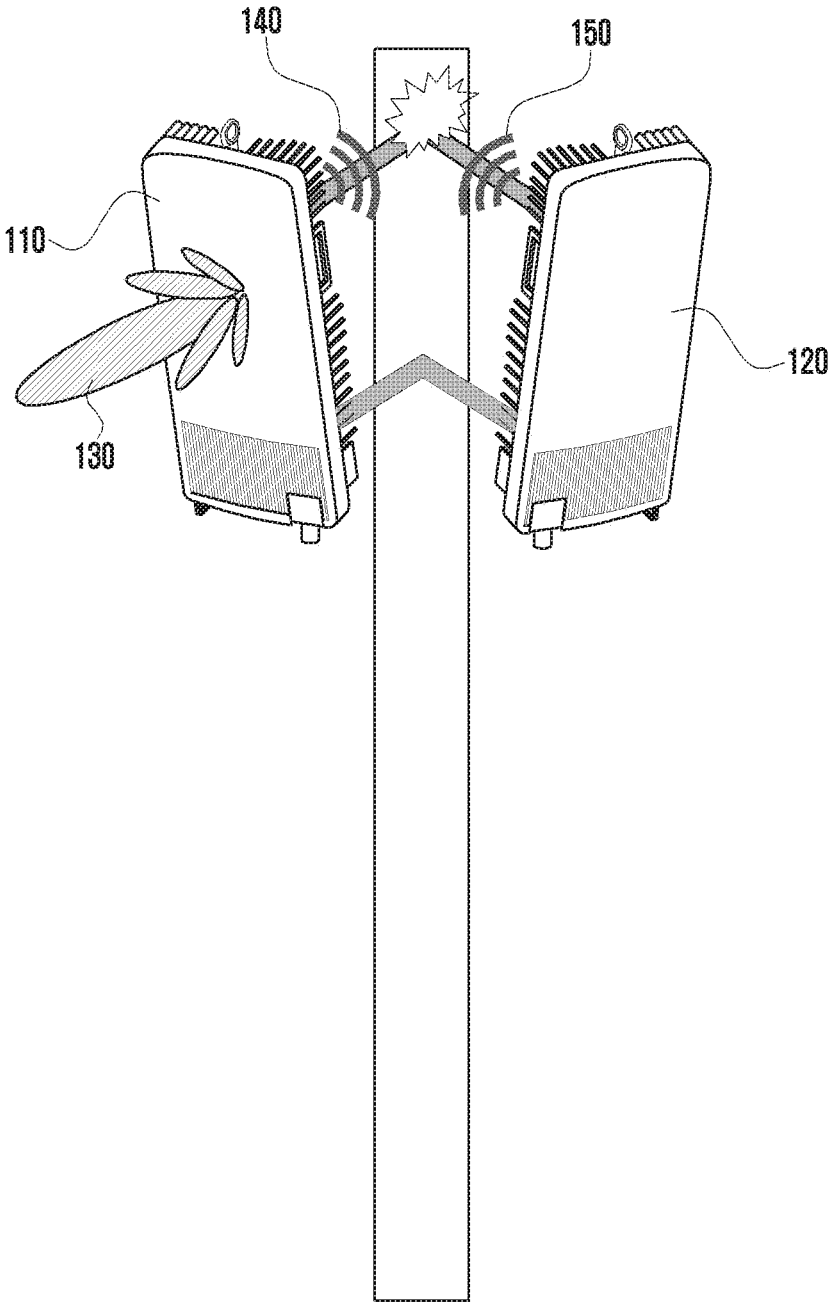
FIG. 1A is a diagram illustrating a case where interference occurs due to radio waves radiated in a back lobe direction according to an embodiment of the disclosure.

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used to enable a clear and consistent understanding of the disclosure. Accordingly, it should be apparent to those skilled in the art that the following description of various embodiments of the disclosure is provided for illustration purpose only, and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

For the same reason, some elements in the drawings are exaggerated, omitted, or schematically illustrated. Also, the size of each element does not entirely reflect the actual size. In the drawings, the same or corresponding elements are denoted by the same reference numerals.

The advantages and features of the disclosure and the manner of achieving them will become apparent with reference to the embodiments described in detail below and with reference to the accompanying drawings. The disclosure may, however, be embodied in many different forms and should not be construed as being limited to the embodiments set forth herein. Rather, these embodiments are provided so that the disclosure will be thorough and complete, and will fully convey the scope of the disclosure to those skilled in the art. To fully disclose the scope of the disclosure to those skilled in the art, the disclosure is only defined by the scope of claims.

It will be understood that each block of flowchart illustrations, and combinations of blocks in flowchart illustrations, may be implemented by computer program instructions. These computer program instructions may be provided to a processor of a general purpose computer, special purpose computer, or other programmable data processing apparatus to produce a machine, such that the instructions, which are executed via the processor of the computer or other programmable data processing apparatus, generate means for implementing the functions specified in the flowchart block or blocks. These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operations to be performed on the computer or other programmable apparatus to produce a computer implemented process such that the instructions that are executed on the computer or other programmable apparatus provide operations for implementing the functions specified in the flowchart block or blocks.

In addition, each block of the flowchart illustrations may represent a module, segment, or portion of code, which comprises one or more executable instructions for implementing the specified logical function(s). It should also be noted that in some alternative implementations, the functions noted in the blocks may occur out of the presented order. For example, two blocks shown in succession may in fact be executed substantially concurrently or the blocks may sometimes be executed in reverse order, depending upon the functionality involved.

The term "unit" as used herein, refers to a software or hardware component or device, such as a field programmable gate array (FPGA) or application specific integrated circuit (ASIC), which performs certain tasks. Therefore, a "unit" may be configured to reside on an addressable storage medium and configured to execute on one or more processors. Thus, a "module" or "unit" may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and modules. In addition, the components and units may be implemented to operate one or more central processing units (CPUs) in a device or a secure multimedia card. In embodiments, a certain unit may include one or more processors.

FIG. 1A is a diagram illustrating a case where interference occurs due to radio waves radiated in a back lobe direction according to an embodiment of the disclosure.

Referring to FIG. 1A, according to embodiments, a base station may include a first antenna module 110 and a second antenna module 120. The first and second antenna modules 110 and 120 may have different main lobe directions. A direction of a main lobe 130 refers to a main direction in which each antenna module radiates radio waves.

According to embodiments, in a frequency band to which a 5G communication system is applied, each base station may include two or more antenna modules because of high linearity of radio waves. For example, the base station may include three antenna modules, and each antenna module may cover 120 degrees in the 360-degree coverage of the base station.

According to embodiments, for various reasons, radio waves radiated by the first and second antenna modules 110 and 120 may direct toward back lobes 140 and 150. The reason why the radio waves are radiated in the back lobe direction will be described below with reference to FIG. 2A. The radio waves radiated in the back lobe direction of the first antenna module 110 and the radio waves radiated in the back lobe direction of the second antenna module 120 may interfere with each other. Such interference may deteriorate performance (e.g., a gain value in the main lobe direction, a frequency bandwidth, etc.) of the first and second antenna modules 110 and 120.

Figure 1B:
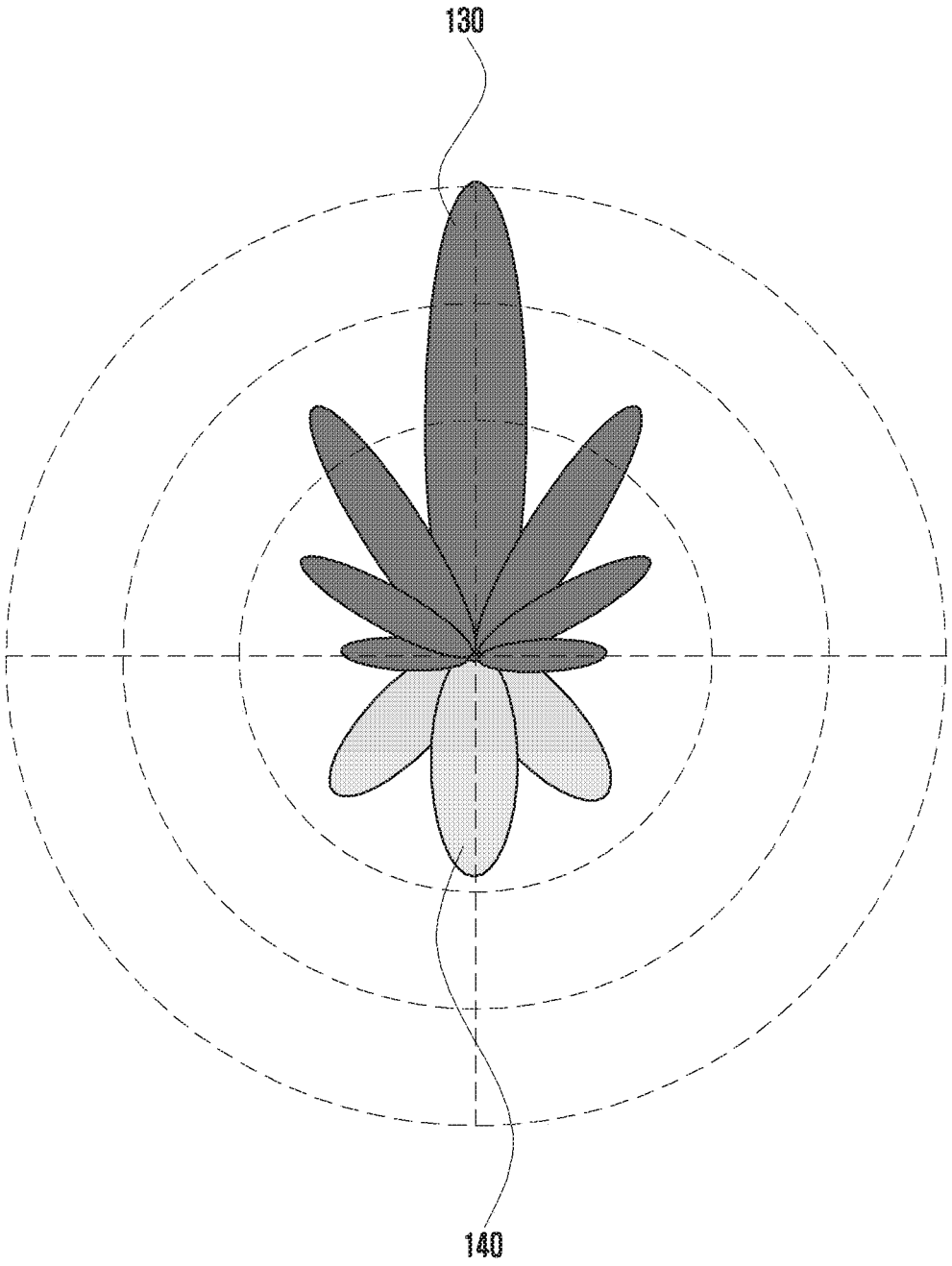
FIG. 1B is a diagram illustrating a radiation beam pattern generated in a typical antenna module structure according to an embodiment of the disclosure.

FIG. 1B is a diagram illustrating a radiation beam pattern generated in a typical antenna module structure according to an embodiment of the disclosure.

Referring to FIG. 1B, according to embodiments, the radio waves radiated by the antenna module may be classified into radio waves radiated toward the main lobe 130 and radio waves radiated toward the back lobe 140. The direction of the main lobe 130 refers to a desired beam direction of radio waves radiated by the antenna module. In contrast, the direction of the back lobe 140 opposite to the main lobe direction refers to an undesired beam direction of radio wave radiated by the antenna module.

According to embodiments, the performance of the antenna module may be deteriorated as the amount of radio waves radiated toward the main lobe 130 decreases or the amount of radio waves radiated toward the back lobe 140 increases.

Figure 2:
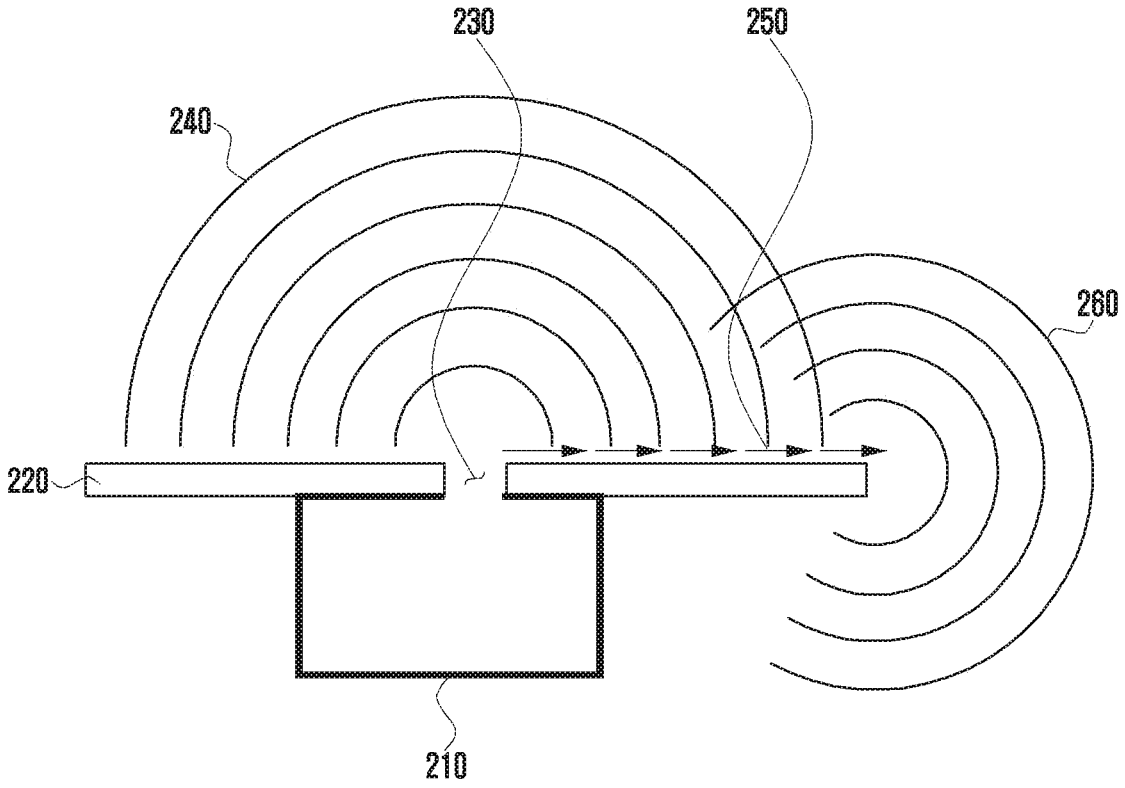
FIG. 2 is a diagram illustrating a reason that radio waves are radiated in a back lobe direction according to an embodiment of the disclosure.

FIG. 2 is a diagram illustrating a reason that radio waves are radiated in a back lobe direction according to an embodiment of the disclosure.

Referring to FIG. 2, according to embodiments, radio waves may be radiated outward at a wave guide 210 through a slot 230, thus forming a radiation beam pattern 240. A direction of the radiation beam pattern 240 formed through the slot 230 corresponds to the above-discussed main lobe direction.

According to embodiments, the slot 230 may be formed in a non-insulating material 220. For example, the non-insulating material 220 may be a portion of a printed circuit board (PCB), and may include a ground layer.

According to embodiments, a part 250 of the radio waves radiated to the outside through the slot 230 may be guided and flow along a surface of the non-insulating material 220. This guided and flowing part 250 of the radio waves may be radiated at an end of the non-insulating material 220.

According to embodiments, the radio waves 250 guided along the surface of the non-insulating material 220 forms an unwanted radiation beam pattern 260 at the end of the non-insulating material 220. A direction of this radiation beam pattern 260 corresponds to, at least in part, the above-discussed back lobe direction. For example, the radio waves 250 may be guided in the form of a surface wave along the surface of the non-insulating material 220 and radiated in the direction of the back lobe of the antenna module.

Figure 3:
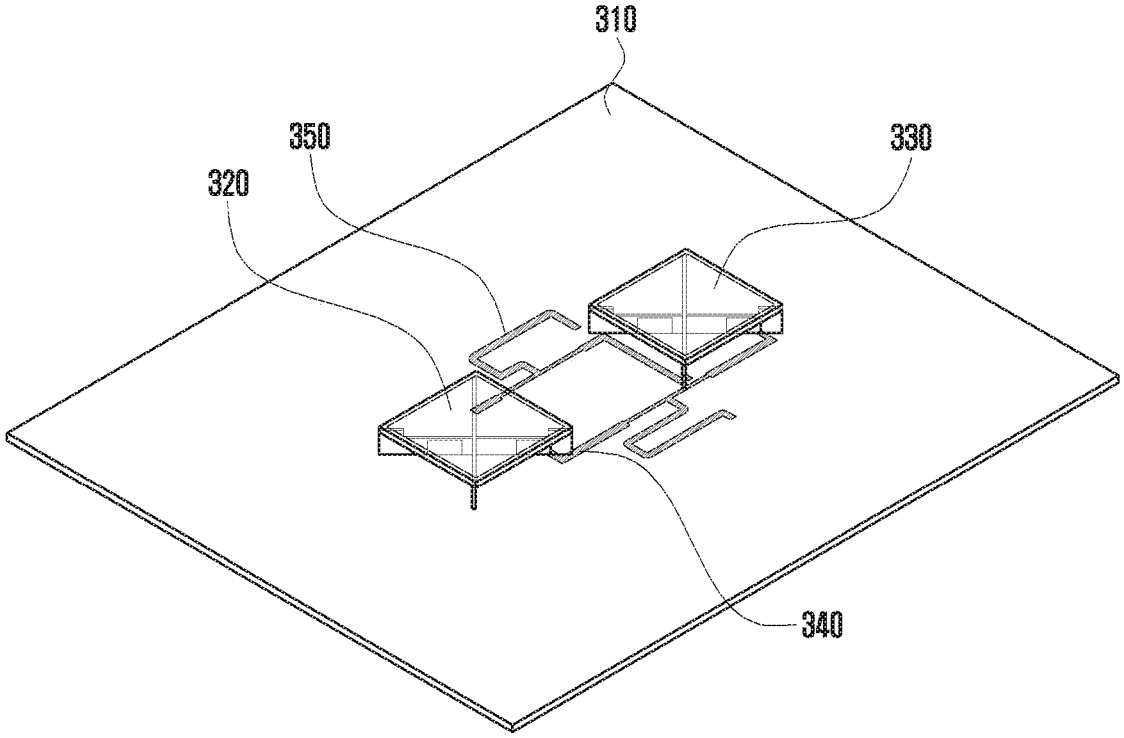
FIG. 3 is a diagram illustrating a structure of an antenna module according to an embodiment of the disclosure.

FIG. 3 is a diagram illustrating a structure of an antenna module according to an embodiment of the disclosure.

Referring to FIG. 3, according to embodiments, the antenna module may include a printed circuit board (PCB) 310, a first antenna array 320, and a second antenna array 330. The PCB 310 may include at least one insulating layer. The first antenna array 320 may receive, from a wireless communication chip (not shown), electrical signals for radiating vertically polarized waves and electrical signals for radiating horizontally polarized waves and thereby radiate the vertically polarized waves and the horizontally polarized waves. The second antenna array 330 may be spaced apart from the first antenna array 320 by a predetermined first distance. The second antenna array 330 may receive, from the wireless communication chip, electrical signals for radiating vertically polarized waves and electrical signals for radiating horizontally polarized waves and thereby radiate the vertically polarized waves and the horizontally polarized waves. The wireless communication chip may be disposed on a lower surface of the PCB 310 to supply electrical signals for radiating radio waves.

According to embodiments, a first conductive pattern 340 and a second conductive pattern 350 may be formed on an upper surface of the PCB 310. The first conductive pattern 340 may supply electrical signals for vertically polarized waves to the first and second antenna arrays 320 and 330 from the wireless communication chip, and the second conductive pattern 350 may supply electrical signals for horizontally polarized waves to the first and second antenna arrays 320 and 330 from the wireless communication chip.

According to embodiments, each of the first and second antenna arrays 320 and 330 may include a radiator, a first feeder, and a second feeder. The radiator may be spaced apart from the upper surface of the PCB 310 by a predetermined second distance and radiate radio waves in the direction of the main lobe. The first feeder may be electrically connected to the first conductive pattern 340 and supply electrical signals for vertically polarized waves to the radiator through the first conductive pattern 340. The second feeder may be electrically connected to the second conductive pattern 350 and supply electrical signals for horizontally polarized waves to the radiator through the second conductive pattern 350.

According to embodiments, each of the first and second feeders may be spaced apart from the radiator by a third distance determined based on a wavelength of radio waves radiated through the radiator. An extension line of the first feeder and an extension line of the second feeder may be perpendicular to each other on the same plane. This can improve isolation between horizontally polarized waves and vertically polarized waves.

The antenna module structure shown in FIG. 3 is one embodiment of the disclosure. Therefore, the disclosure is not be limited to the antenna module structure shown in FIG. 3.

Figure 4:
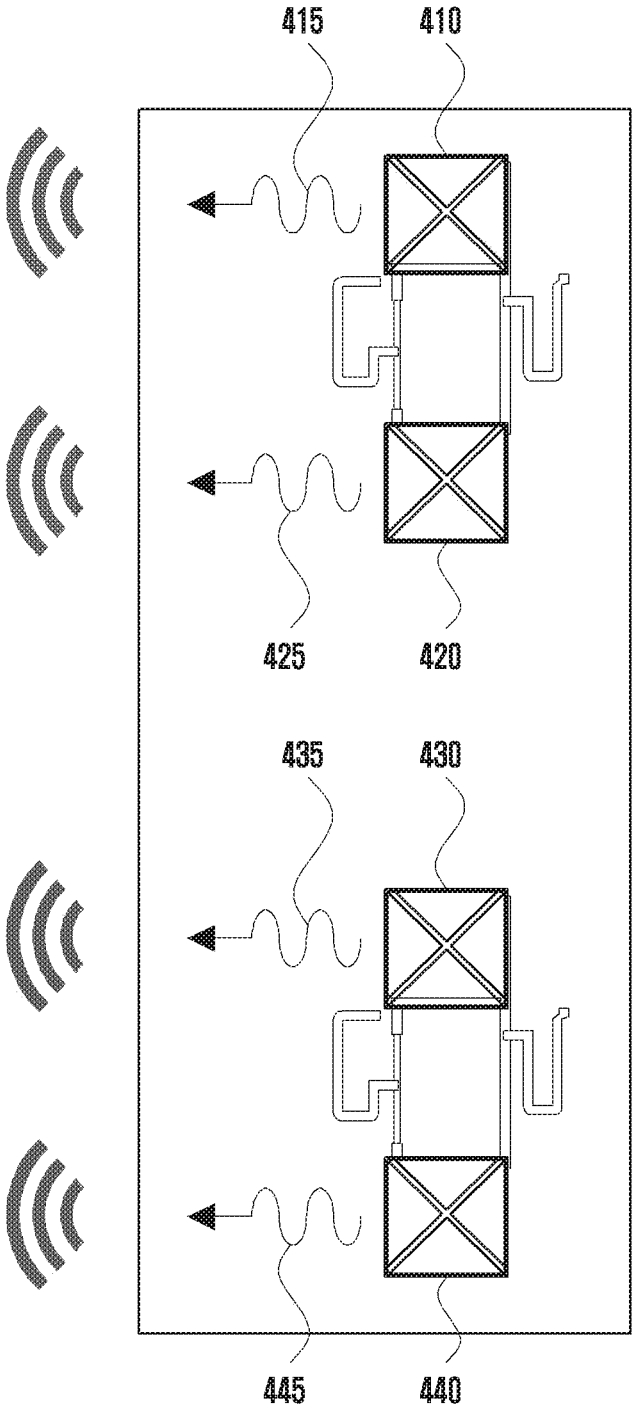
FIG. 4 is a diagram illustrating radio waves radiated in a back lobe direction in an antenna module according to an embodiment of the disclosure.

FIG. 4 is a diagram illustrating radio waves radiated in a back lobe direction in an antenna module according to an embodiment of the disclosure.

Referring to FIG. 4, according to embodiments, a part 415 of radio waves radiated by a first antenna array 410 may be guided along an upper surface of a PCB and flow to an end of the PCB. Similarly, a part 425 of radio waves radiated by a second antenna array 420, a part 435 of radio waves radiated by a third antenna array 430, and a part 445 of radio waves radiated by a fourth antenna array 440 may be guided along the upper surface of the PCB and flow to the end of the PCB.

According to embodiments, as described above with reference to FIG. 2, the respective parts 415, 425, 435, and 445 of radio waves radiated by the first, second, third, and fourth antenna arrays 410, 420, 430, and 440 and guided along the upper surface of the PCB may be radiated from the end of the PCB. In addition, these parts of radio waves radiated from the end of the PCB may direct at least in part toward the back lobe direction of the antenna module.

Figure 5:
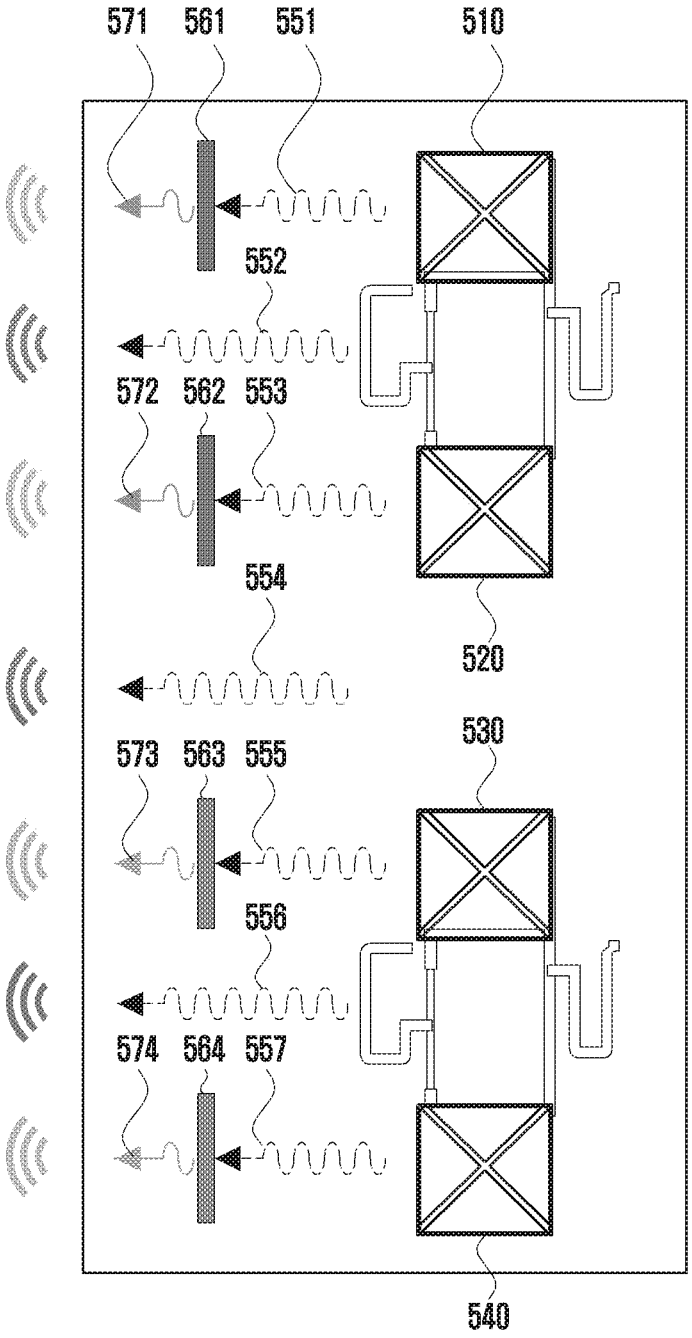
FIG. 5 is a diagram illustrating radio waves radiated in a back lobe direction in an antenna module including a metal structure according to an embodiment of the disclosure.

FIG. 5 is a diagram illustrating radio waves radiated in a back lobe direction in an antenna module including a metal structure according to an embodiment of the disclosure.

Referring to FIG. 5, according to embodiments, a first antenna module may include a first antenna array 510 and a second antenna array 520, and a second antenna module may include a third antenna array 530 and a fourth antenna array 540. The first antenna module may radiate first radio waves 551, second radio waves 552, third radio waves 553, and fourth radio waves 554, all of which are guided along an upper surface of a PCB and flow toward an end of the PCB and contribute to potential radio waves radiated toward a back lobe of the antenna module. The second antenna module may radiate fifth radio waves 555, sixth radio waves 556, and seventy radio waves 557, all of which are also guided along an upper surface of the PCB and flow toward an end of the PCB and contribute to potential radio waves radiated toward a back lobe of the antenna module.

According to embodiments, the first radio waves 551 may pass through a first metal structure 561 disposed on the upper surface of the PCB. The first metal structure 561 may shift the phase of the first radio waves 551 by 180 degrees, for example. In addition, the third radio waves 553 may pass through a second metal structure 562 disposed on the upper surface of the PCB. The second metal structure 562 may shift the phase of the third radio waves 553 by 180 degrees, for example.

According to embodiments, phase-shifted first radio waves 571 having the phase shifted by the first metal structure 561 may be in a destructive interference relationship with the second radio waves 552. That is, the phase-shifted first radio waves 571 and the second radio waves 552 may be canceled with each other. As a result, the amount of radio waves radiated in the back lobe direction of the first antenna module by the first and second radio waves 551 and 552 may be significantly reduced.

Similarly, phase-shifted third radio waves 572 having the phase shifted by the second metal structure 562 may be in a destructive interference relationship with the fourth radio waves 554. That is, the phase-shifted third radio waves 572 and the fourth radio waves 554 may be canceled with each other. As a result, the amount of radio waves radiated in the back lobe direction of the first antenna module by the third and fourth radio waves 553 and 554 may be significantly reduced.

According to embodiments, the second antenna module composed of the third and fourth antenna arrays 530 and 540 may have the same or similar operations as or to those of the first antenna module described above. For example, the phase of fifth radio waves 555 may be shifted by a third metal structure 563, and phase-shifted fifth radio waves 573 may be in a destructive interference relationship with sixth radio waves 556. Similarly, a phase of seventh radio waves 557 may be shifted by 180 degrees by a fourth metal structure 564, and phase-shifted seventh radio waves 574 may be in a destructive interference relationship with eighth radio waves (not shown).

According to embodiments, a space between the metal structures 561, 562, 563, and 564 disposed on the upper surface of the PCB may be determined based on the wavelength of radio waves 551 to 557 radiated by the antenna module. For example, a space between the first and second metal structures 561 and 562 may be 0.5λ to 0.7λ (wherein 'λ' denotes the wavelength of radio waves 551 to 553 radiated by the antenna module). A space between the third and fourth metal structures 563 and 564 may be 0.5λ to 0.7λ (wherein 'λ' denotes the wavelength of radio waves 555 to 557 radiated by the antenna module).

Figure 6A:
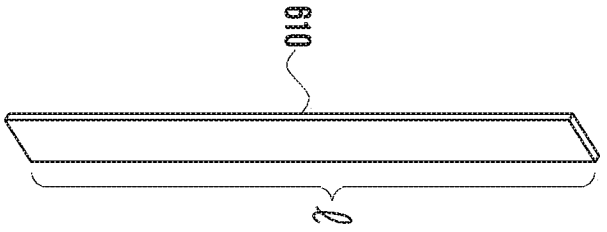
FIG. 6A is a diagram illustrating a metal structure according to an embodiment of the disclosure.

FIG. 6A is a diagram illustrating a metal structure according to an embodiment of the disclosure.

Referring to FIG. 6A, according to the first embodiment, a metal structure 610 (corresponding to any one of 561 to 564) may have an elongated shape. A length (l) of the metal structure 610 may be determined based on the wavelength of radio waves radiated by the antenna module. For example, the length of the metal structure may be determined using Equation 1 below.

$$l=\lambda/2 \qquad \text{Equation 1}$$

In Equation 1, 'l' denotes the length of the metal structure, and 'λ' denotes the wavelength of radio waves radiated by the antenna module.

Figure 6B:
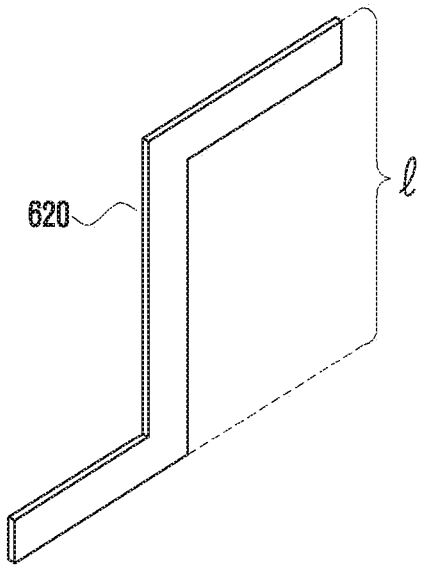
FIG. 6B is a diagram illustrating another metal structure according to an embodiment of the disclosure.

FIG. 6B is a diagram illustrating another metal structure according to an embodiment of the disclosure.

Referring to FIG. 6B, according to a second embodiment, a metal structure 620 may have a specific shape shown in FIG. 6B. A total length (l) of the metal structure shown in FIG. 6B may be determined based on the wavelength of radio waves radiated by the antenna module. For example, the total length of the metal structure shown in FIG. 6B may be a value obtained by dividing the wavelength of radio waves by two.

Figure 6C:
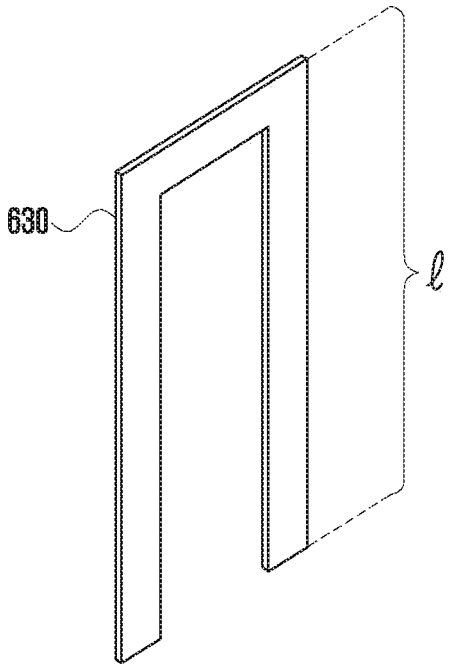
FIG. 6C is a diagram illustrating another metal structure according to an embodiment of the disclosure.

FIG. 6C is a diagram illustrating another metal structure according to an embodiment of the disclosure.

Referring to FIG. 6C, according to a third embodiment, a metal structure 630 may have a specific shape shown in FIG. 6C. A total length (l) of the metal structure shown in FIG. 6C may be determined based on the wavelength of radio waves radiated by the antenna module. For example, the total length of the metal structure shown in FIG. 6C may be a value obtained by dividing the wavelength of radio waves by two.

Figure 6D:
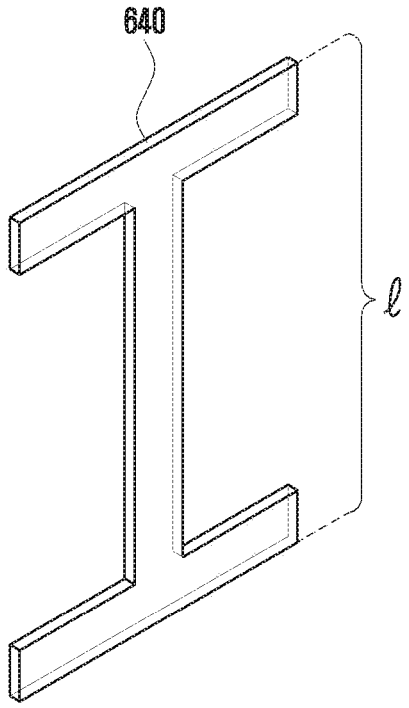
FIG. 6D is a diagram illustrating another metal structure according to an embodiment of the disclosure.

FIG. 6D is a diagram illustrating another metal structure according to an embodiment of the disclosure.

Referring to FIG. 6D, according to a fourth embodiment, a metal structure 640 may have a specific shape shown in FIG. 6D. A total length (l) of the metal structure shown in FIG. 6D may be determined based on the wavelength of radio waves radiated by the antenna module. For example, the total length of the metal structure shown in FIG. 6D may be a value obtained by dividing the wavelength of radio waves by two.

Figure 6E:
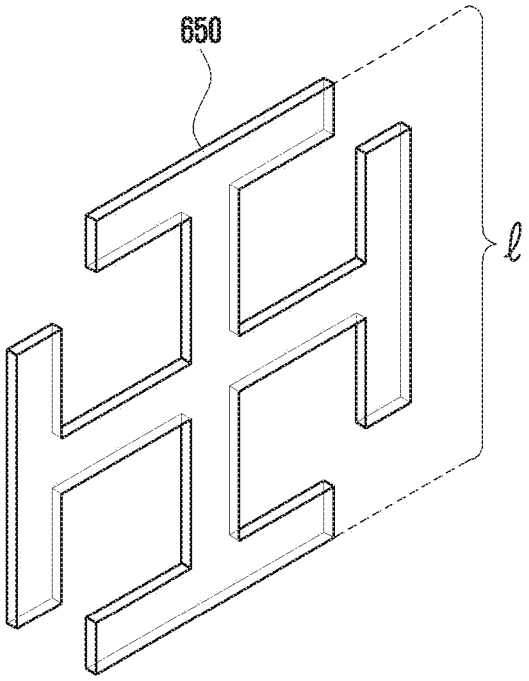
FIG. 6E is a diagram illustrating another metal structure according to an embodiment of the disclosure.

FIG. 6E is a diagram illustrating another metal structure according to an embodiment of the disclosure.

Referring to FIG. 6E, according to a fifth embodiment, a metal structure 650 may have a specific shape shown in FIG. 6E. A total length (l) of the metal structure shown in FIG. 6E may be determined based on the wavelength of radio waves radiated by the antenna module. For example, the total length of the metal structure shown in FIG. 6E may be a value obtained by dividing the wavelength of radio waves by two.

FIGS. 6A to 6E show embodiments of the metal structures 561 to 564, but the disclosure is not limited thereto. The length and shape of the metal structures may be varied according to the structures of the antenna module. For example, the length (l) of the metal structures may range from 0.3λ to 0.7λ, and the metal structures may have a square ring shape, a circular ring shape, or any other shape.

Figure 7:
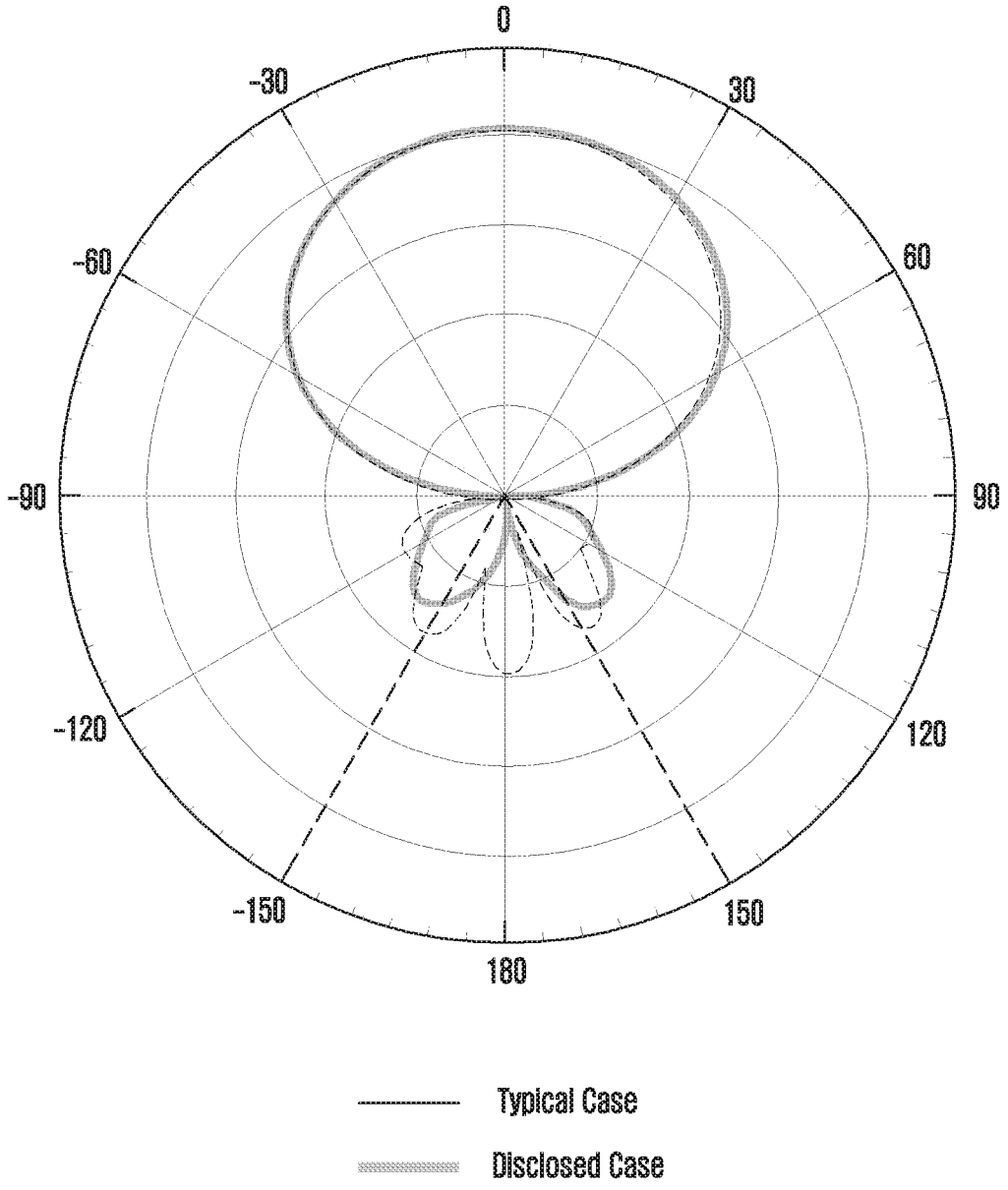
FIG. 7 is a diagram illustrating a radiation beam pattern generated in an antenna module structure according to an embodiment of the disclosure.

FIG. 7 is a diagram illustrating a radiation beam pattern generated in an antenna module structure according to an embodiment of the disclosure.

Referring to FIG. 7, it can be seen that an amount of radio waves radiated in a back lobe direction of an antenna module according to an embodiment of the disclosure is greatly reduced in comparison with a typical case. In general, the radio waves radiated in the back lobe direction may refer to radio waves radiated in directions between 150 and 180 degrees and between −150 and −180 degrees.

In a typical case, it can be seen that a certain amount of radio waves are radiated between −150 and 150 degrees. However, in case of the antenna module structure including a metal structure according to embodiments of the disclosure, it can be seen that the amount of radio waves radiated between −150 and 150 degrees is significantly reduced in comparison with the typical case. That is, FIG. 7 shows that the amount of radio waves radiated in the back lobe direction of the antenna module is reduced.

Figure 8A:
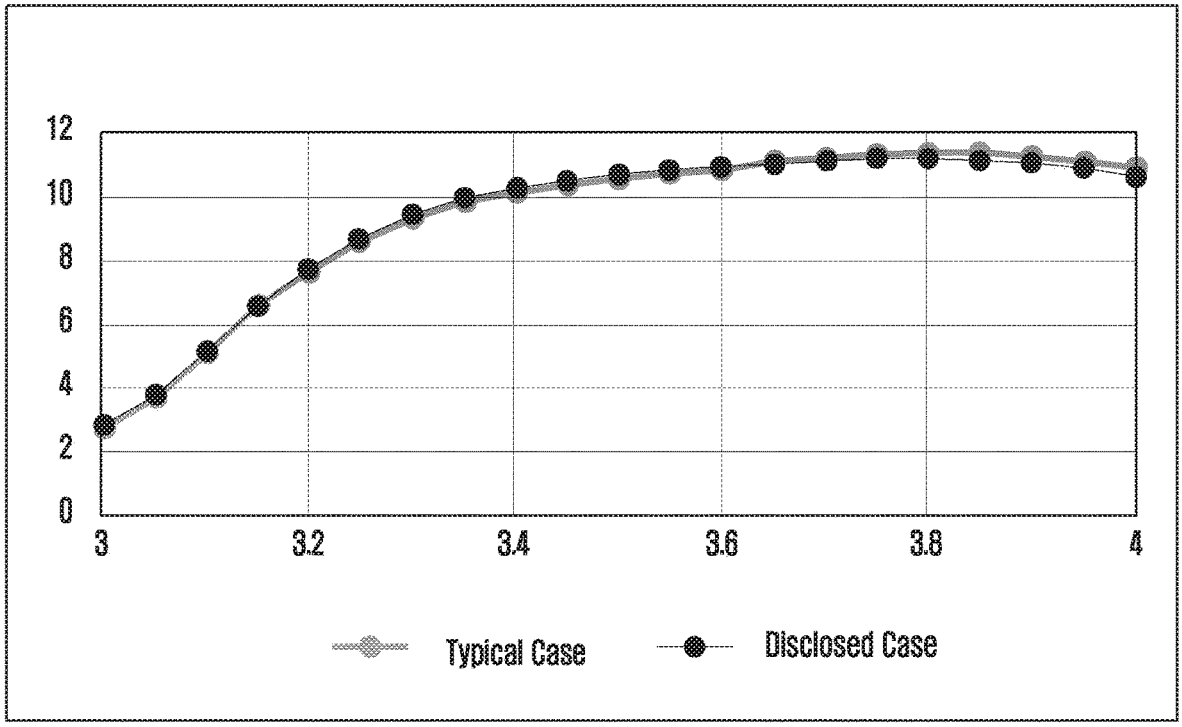
FIG. 8A is a diagram illustrating a comparison of a gain value between an antenna module structure according to an embodiment of the disclosure and a typical antenna module structure.

FIG. 8A is a diagram illustrating a comparison of a gain value between an antenna module structure according to embodiments of the disclosure and a typical antenna module structure.

Referring to FIG. 8A, it can be seen that a gain value of an antenna module does not differ much between a case of the disclosure and a typical case. Generally, when an auxiliary device is added to the antenna module to reduce the amount of radio waves radiated in the back lobe direction, the gain value of the antenna module may be reduced due to the added auxiliary device. However, even if a metal structure is additionally disposed in the antenna module according to embodiments of the disclosure, the gain value of the antenna module may not be affected.

Figure 8B:
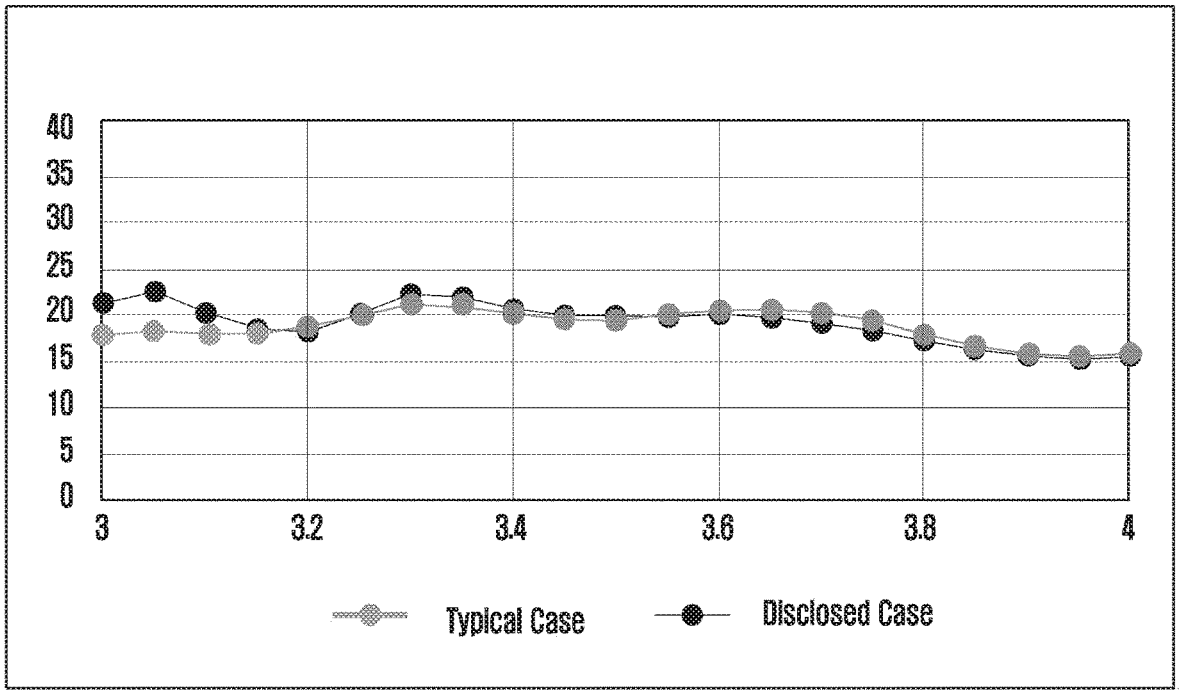
FIG. 8B is a diagram illustrating a comparison of a cross polarization ratio (CPR) value between an antenna module structure according to an embodiment of the disclosure and a typical antenna module structure.

FIG. 8B is a diagram illustrating a comparison of a cross polarization ratio (CPR) value between an antenna module structure according to embodiments of the disclosure and a typical antenna module structure.

Referring to FIG. 8B, a CPR value refers to a ratio of components to be radiated through an antenna module to components not to be radiated. Generally, when an auxiliary device is added to the antenna module to reduce the amount of radio waves radiated in the back lobe direction, the CPR value of the antenna module may be reduced due to the added auxiliary device. However, even if a metal structure is additionally disposed in the antenna module according to embodiments of the disclosure, the CPR value of the antenna module may not be affected.

Figure 8C:
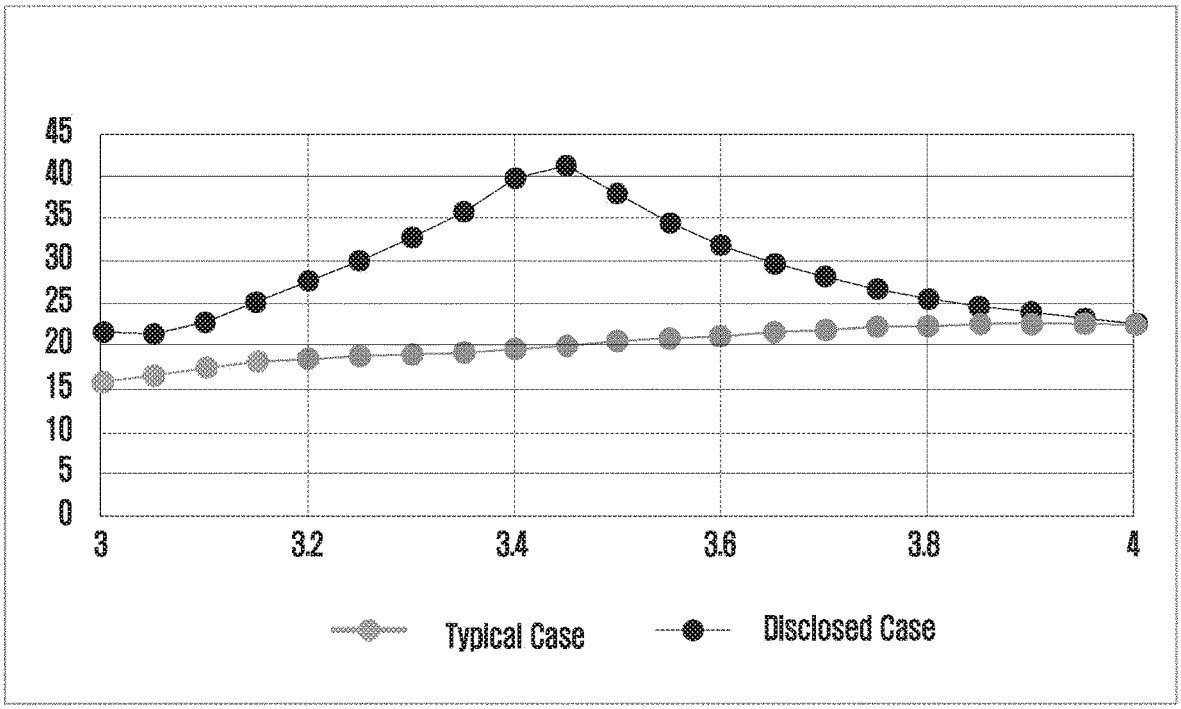
FIG. 8C is a diagram illustrating a comparison of a front to back ratio (FBR) value between an antenna module structure according to an embodiment of the disclosure and a typical antenna module structure.

FIG. 8C is a diagram illustrating a comparison of a front to back ratio (FBR) value between an antenna module structure according to embodiments of the disclosure and a typical antenna module structure.

Referring to FIG. 8C, an FBR value refers to a ratio of radio waves radiated forward through an antenna module to radio waves radiated backward. That is, the FBR value means the ratio of radio waves radiated in the main lobe direction of the antenna module to radio waves radiated in the back lobe direction.

As can be seen through FIG. 8C, the FBR value in an embodiment of the disclosure is higher than the FBR value in a typical case. That is, it can be seen from FIG. 8C that the amount of radio waves radiated in the back lobe direction by the antenna module according to the disclosure is less than the amount of radio waves radiated in the back lobe direction by a typical antenna module.

According to embodiments of the disclosure, an antenna module as described above may include a printed circuit board (PCB) including at least one insulating layer, at least one antenna array disposed on an upper surface of the PCB, and at least one metal structure disposed on the upper surface of the PCB and shifting a phase of radio waves radiated by the at least one antenna array and flowing along the upper surface of the PCB.

According to embodiments of the disclosure, in the antenna module as described above, the metal structure may shift a phase of a part of the radio waves flowing along the upper surface of the PCB and thereby reduce the radio waves radiated toward a back lobe of the antenna module.

According to embodiments of the disclosure, in the antenna module described above, the metal structure may shift a phase of a part of the radio waves flowing along the upper surface of the PCB by 180 degrees.

According to embodiments of the disclosure, in the antenna module described above, among the radio waves flowing along the upper surface of the PCB, a first radio wave whose phase is shifted by passing through the metal structure may be in a destructive interference relationship with a second radio wave which is not affected by the metal structure.

According to embodiments of the disclosure, in the antenna module described above, one or more of a length of each metal structure and a space between the metal structures may be determined based on a wavelength of the radio waves radiated by the antenna array.

According to embodiments of the disclosure, in the antenna module described above, a length of the metal structure may be determined as $l=\lambda/2$, where 'l' denotes the length of the metal structure, and 'λ' denotes a wavelength of radio waves radiated by the antenna module.

According to embodiments of the disclosure, the antenna module described above may further include a wireless communication chip disposed on a lower surface of the PCB and transmitting electrical signals for radiating the radio waves, and the PCB may include a conductive pattern formed on the upper surface thereof and transmitting the electrical signals from the wireless communication chip to the at least one antenna array.

According to embodiments of the disclosure, in the antenna module described above, the at least one antenna array may include a first antenna array receiving, from the wireless communication chip, electrical signals for radiating vertically polarized waves and electrical signals for radiating horizontally polarized waves, and thereby radiating the vertically polarized waves and the horizontally polarized waves.

According to embodiments of the disclosure, in the antenna module described above, the at least one antenna array may further include a second antenna array spaced apart from the first antenna array by a predetermined first distance, receiving, from the wireless communication chip, electrical signals for radiating vertically polarized waves and electrical signals for radiating horizontally polarized waves, and thereby radiating the vertically polarized waves and the horizontally polarized waves.

According to embodiments of the disclosure, in the antenna module described above, each of the first and second antenna arrays may include a radiator spaced apart from the upper surface of the PCB by a predetermined second distance and radiating radio waves in a direction of a main lobe of the antenna module, a first feeder electrically connected to the conductive pattern and supplying the electrical signals for vertically polarized waves to the radiator, and a second feeder electrically connected to the conductive pattern and supplying the electrical signals for horizontally polarized waves to the radiator.

According to embodiments of the disclosure, in the antenna module described above, each of the first and second feeders may be spaced apart from the radiator by a third distance determined based on a wavelength of radio waves radiated through the radiator, and an extension line of the first feeder and an extension line of the second feeder may be perpendicular to each other.

According to embodiments of the disclosure, an electronic device may include an antenna module described above that includes a printed circuit board (PCB) including at least one insulating layer, at least one antenna array disposed on an upper surface of the PCB, and at least one metal structure disposed on the upper surface of the PCB and shifting a phase of radio waves radiated by the at least one antenna array and flowing along the upper surface of the PCB.

According to embodiments of the disclosure, in the electronic device described above, the metal structure may shift a phase of a part of the radio waves flowing along the upper surface of the PCB and thereby reduce the radio waves radiated toward a back lobe of the antenna module.

According to embodiments of the disclosure, in the antenna module described above, the metal structure may shift a phase of a part of the radio waves flowing along the upper surface of the PCB by 180 degrees.

According to embodiments of the disclosure, in the electronic device described above, among the radio waves flowing along the upper surface of the PCB, a first radio wave whose phase is shifted by passing through the metal structure may be in a destructive interference relationship with a second radio wave which is not affected by the metal structure.

According to embodiments of the disclosure, in the electronic device described above, one or more of a length of each metal structure and a space between the metal structures may be determined based on a wavelength of the radio waves radiated by the antenna array.

According to embodiments of the disclosure, in the electronic device described above, a length of the metal structure may be determined as $l=\lambda/2$, where 'l' denotes the length of the metal structure, and '$\lambda$' denotes a wavelength of radio waves radiated by the antenna module.

According to embodiments of the disclosure, the electronic device may further include a wireless communication chip disposed on a lower surface of the PCB and transmitting electrical signals for radiating the radio waves, and the PCB may include a conductive pattern formed on the upper surface thereof and transmitting the electrical signals from the wireless communication chip to the at least one antenna array.

According to embodiments of the disclosure, in the electronic device described above, the at least one antenna array may include a first antenna array receiving, from the wireless communication chip, electrical signals for radiating vertically polarized waves and electrical signals for radiating horizontally polarized waves, and thereby radiating the vertically polarized waves and the horizontally polarized waves.

According to embodiments of the disclosure, in the electronic device described above, the at least one antenna array may further include a second antenna array spaced apart from the first antenna array by a predetermined first distance, receiving, from the wireless communication chip, electrical signals for radiating vertically polarized waves and electrical signals for radiating horizontally polarized waves, and thereby radiating the vertically polarized waves and the horizontally polarized waves.

According to embodiments of the disclosure, in the electronic device described above, each of the first and second antenna arrays may include a radiator spaced apart from the upper surface of the PCB by a predetermined second distance and radiating radio waves in a direction of a main lobe of the antenna module, a first feeder electrically connected to the conductive pattern and supplying the electrical signals for vertically polarized waves to the radiator, and a second feeder electrically connected to the conductive pattern and supplying the electrical signals for horizontally polarized waves to the radiator.

According to embodiments of the disclosure, in the electronic device described above, each of the first and second feeders may be spaced apart from the radiator by a third distance determined based on a wavelength of radio waves radiated through the radiator, and an extension line of the first feeder and an extension line of the second feeder may be perpendicular to each other.

While the disclosure has been shown and described with reference to various embodiments thereof, it will be understood by those skilled in the art that various changes in form and details may be made therein without departing from the spirit and scope of the subject matter as defined by the appended claims and their equivalents.

What is claimed is:

1. An antenna module in a wireless communication system, the antenna module comprising:

a printed circuit board (PCB) including at least one insulating layer;

at least one antenna array disposed on an upper surface of the PCB;

at least one metal structure disposed on the upper surface of the PCB configured to shift a phase of radio waves radiated by the at least one antenna array and flowing along the upper surface of the PCB; and a wireless communication chip disposed on a lower surface of the PCB configured to transmit electrical signals for radiating the radio waves, wherein the PCB comprises a conductive pattern formed on the upper surface thereof configured to transmit the electrical signals from the wireless communication chip to the at least one antenna array.

2. The antenna module of claim 1, wherein the metal structure is further configured to shift a phase of a part of the radio waves flowing along the upper surface of the PCB and reduce the radio waves radiated toward a back lobe of the antenna module.

3. The antenna module of claim 1, wherein the metal structure is further configured to shift a phase of a part of the radio waves flowing along the upper surface of the PCB by 180 degrees.

4. The antenna module of claim 1, wherein, among the radio waves flowing along the upper surface of the PCB, a first radio wave whose phase is shifted by passing through the metal structure is in a destructive interference relationship with a second radio wave which is not affected by the metal structure.

5. The antenna module of claim 1, further comprising a plurality of metal structures, wherein at least one of a length of each metal structure or a space between adjacent metal structures is determined based on a wavelength of radio waves radiated by the antenna array.

6. The antenna module of claim 1, wherein a length of the metal structure is determined using, $$l=\lambda/2,$$

where 'l' denotes a length of the metal structure, and 'λ' denotes a wavelength of radio waves radiated by the antenna module.

7. The antenna module of claim 1, wherein the at least one antenna array comprises:

a first antenna array configured to:

receive, from the wireless communication chip, electrical signals for radiating vertically polarized waves and electrical signals for radiating horizontally polarized waves, and radiate the vertically polarized waves and the horizontally polarized waves; and a second antenna array spaced apart from the first antenna array by a predetermined first distance configured to:

receive, from the wireless communication chip, electrical signals for radiating vertically polarized waves and electrical signals for radiating horizontally polarized waves, and radiate the vertically polarized waves and the horizontally polarized waves.

8. The antenna module of claim 7, wherein each of the first and second antenna arrays comprise:

a radiator spaced apart from the upper surface of the PCB by a predetermined second distance configured to radiate radio waves in a direction of a main lobe of the antenna module;

a first feeder electrically connected to the conductive pattern configured to supply the electrical signals for vertically polarized waves to the radiator; and a second feeder electrically connected to the conductive pattern configured to supply the electrical signals for horizontally polarized waves to the radiator.

9. The antenna module of claim 8, wherein each of the first and second feeders is spaced apart from the radiator by a third distance determined based on a wavelength of radio waves radiated through the radiator, and wherein an extension line of the first feeder and an extension line of the second feeder are perpendicular to each other.

10. An electronic device comprising:

an antenna module including:

a printed circuit board (PCB) including at least one insulating layer, at least one antenna array disposed on an upper surface of the PCB, at least one metal structure disposed on the upper surface of the PCB configured to shift a phase of radio waves radiated by the at least one antenna array and flowing along the upper surface of the PCB, and a wireless communication chip disposed on a lower surface of the PCB configured to transmit electrical signals for radiating the radio waves, wherein the PCB comprises a conductive pattern formed on the upper surface thereof configured to transmit the electrical signals from the wireless communication chip to the at least one antenna array.

11. The electronic device of claim 10, wherein the metal structure is further configured to shift a phase of a part of the radio waves flowing along the upper surface of the PCB and reduce the radio waves radiated toward a back lobe of the antenna module.

12. The electronic device of claim 10, wherein the metal structure is further configured to shift a phase of a part of the radio waves flowing along the upper surface of the PCB by 180 degrees.

13. The electronic device of claim 10, wherein, among the radio waves flowing along the upper surface of the PCB, a first radio wave whose phase is shifted by passing through the metal structure is in a destructive interference relationship with a second radio wave which is not affected by the metal structure.

14. The electronic device of claim 10, further comprising a plurality of metal structures, wherein at least one of a length of each metal structure or a space between adjacent metal structures is determined based on a wavelength of radio waves radiated by the antenna array.

15. The electronic device of claim 10, wherein a length of the metal structure is determined using, $$l=\lambda/2,$$

where 'l' denotes a length of the metal structure, and 'λ' denotes a wavelength of radio waves radiated by the antenna module.

16. The electronic device of claim 10, wherein the at least one antenna array comprises:

a first antenna array configured to:

receive, from the wireless communication chip, electrical signals for radiating vertically polarized waves and electrical signals for radiating horizontally polarized waves, and radiate the vertically polarized waves and the horizontally polarized waves; and a second antenna array spaced apart from the first antenna array by a predetermined first distance configured to:

receive, from the wireless communication chip, electrical signals for radiating vertically polarized waves and electrical signals for radiating horizontally polarized waves, and radiate the vertically polarized waves and the horizontally polarized waves.

17. The electronic device of claim 16, wherein each of the first and second antenna arrays comprises:

a radiator spaced apart from the upper surface of the PCB by a predetermined second distance configured to radiate radio waves in a direction of a main lobe of the antenna module;

a first feeder electrically connected to the conductive pattern configured to supply the electrical signals for vertically polarized waves to the radiator; and a second feeder electrically connected to the conductive pattern configured to supply the electrical signals for horizontally polarized waves to the radiator.

18. The electronic device of claim 17, wherein each of the first and second feeders is spaced apart from the radiator by a third distance determined based on a wavelength of radio waves radiated through the radiator, and wherein an extension line of the first feeder and an extension line of the second feeder are perpendicular to each other.

* * * * *